US005988377A

United States Patent [19]

Pugel et al.

[11] Patent Number: 5,988,377

[45] Date of Patent: Nov. 23, 1999

[54] BODY BOARD BAG WITH SPECIAL CLOSURES

[76] Inventors: Thomas M. Pugel, 937 S. 2nd, Calimesa, Calif. 92320; Ronald R. Enriquez, 1323 Huntington St., Huntington Beach, Calif. 92648

[21] Appl. No.: 08/961,073

[22] Filed: Oct. 30, 1997

[51] Int. Cl.[6] ..... B65D 33/01

[52] U.S. Cl. ..... 206/315.1; 190/119; 383/87

[58] Field of Search ..... 150/117, 118, 150/127; 190/111, 119, 124; 206/315.1, 579; 383/49, 71, 87, 99, 103, 118, 121

[56] References Cited

U.S. PATENT DOCUMENTS

| | | | |
|---|---|---|---|
| 3,339,607 | 9/1967 | Howard | 150/52 |
| 4,461,030 | 7/1984 | Knudsen | 383/87 |
| 4,483,380 | 11/1984 | Beran | 150/52 R |
| 4,793,535 | 12/1988 | Johnson | 224/329 |
| 4,883,207 | 11/1989 | McArthur | 224/153 |
| 5,033,497 | 7/1991 | Hernandez | 135/95 |
| 5,094,344 | 3/1992 | Savage | 206/315.1 |
| 5,193,677 | 3/1993 | Moreno | 206/315.1 |
| 5,228,547 | 7/1993 | Yoo | 190/111 |

*Primary Examiner*—Jim Foster

*Attorney, Agent, or Firm*—David Volk

[57] ABSTRACT

A compartment includes a first broad panel adapted to cover a first side of a body board, and a second broad panel adapted to cover a second side of the body board. The first broad panel includes an elastic lined first lip at a distal end of the first broad panel, and the second broad panel includes an elastic lined second lip at a distal end of the second broad panel. The lips form a boundary of an opening adapted for the body board to be inserted there-through and into the compartment. The first broad panel is adapted to extend over a distal end of the body board so that the first lip is positioned on the second side of the body board, and the second broad panel is adapted to extend over the distal end of the body board so that the second lip is positioned on the first side of the body board. An accessory compartment is attached to the second broad panel. The accessory compartment includes structure forming an elongated accessory compartment opening. The accessory compartment opening is positioned generally in a center of the accessory compartment, and divides the accessory compartment into two sections. The accessory compartment is adapted to retain at least two swim fins therein, at least one of the swim fins in each of the sections. The accessory compartment opening is bounded by two elastic lined elongated edges, whereby the swim fins are securely retainable within the sections.

3 Claims, 3 Drawing Sheets

BODY BOARD BAG WITH SPECIAL CLOSURES

BACKGROUND OF THE INVENTION

1. Field of the Invention

The present invention relates to carriers, particularly to a carrier for a body board.

2. Description of the Related

Body boards should be protected from sun exposure, which can cause fading and material breakdown, and should also be protected from abrasion and damage during transportation.

What is needed is a specially designed carrier for a body board which is easy to use and carry, which protects the body board and accessories such as swim fins from damage, and which can remain relatively clean of sand and debris.

SUMMARY OF THE INVENTION

The body board bag of the present invention includes a compartment adapted to enclose a body board therein. The compartment includes a first broad panel adapted to cover a first side of the body board, and a second broad panel adapted to cover a second side of the body board. The first broad panel includes an elastic lined first lip at a distal end of the first broad panel, and the second broad panel includes an elastic lined second lip at a distal end of the second broad panel. The lips form a boundary of an opening adapted for the body board to be inserted there-through and into the compartment.

The first broad panel is adapted to extend over a distal end of the body board so that the first lip is positioned on the second side of the body board, and the second broad panel is adapted to extend over the distal end of the body board so that the second lip is positioned on the first side of the body board.

An accessory compartment is attached to the second broad panel. The accessory compartment includes structure forming an elongated accessory compartment opening. The accessory compartment opening is positioned generally in a center of the accessory compartment, and divides the accessory compartment into two sections. The accessory compartment is adapted to retain at least two swim fins therein, at least one of the swim fins in each of the sections. The accessory compartment opening is bounded by two elastic lined elongated edges, whereby the swim fins are securely retainable within the sections.

Eyelets in the bottom of the compartment and the accessory compartment permit sand, water and debris to fall there-through when the bag is in an upright position.

Shoulder straps attached to the first broad panel permit the bag to be carried on a person's back in a conventional manner.

Because the opening and the accessory compartment opening are each bounded by elastic lined structure, no other closures such as zippers, buttons or snaps are necessary; thus, the body board is protected from scratches, gouges or other damage from such closures.

Still further features and advantages will become apparent from the ensuing description and drawings.

DETAILED DESCRIPTION

Figure 1:
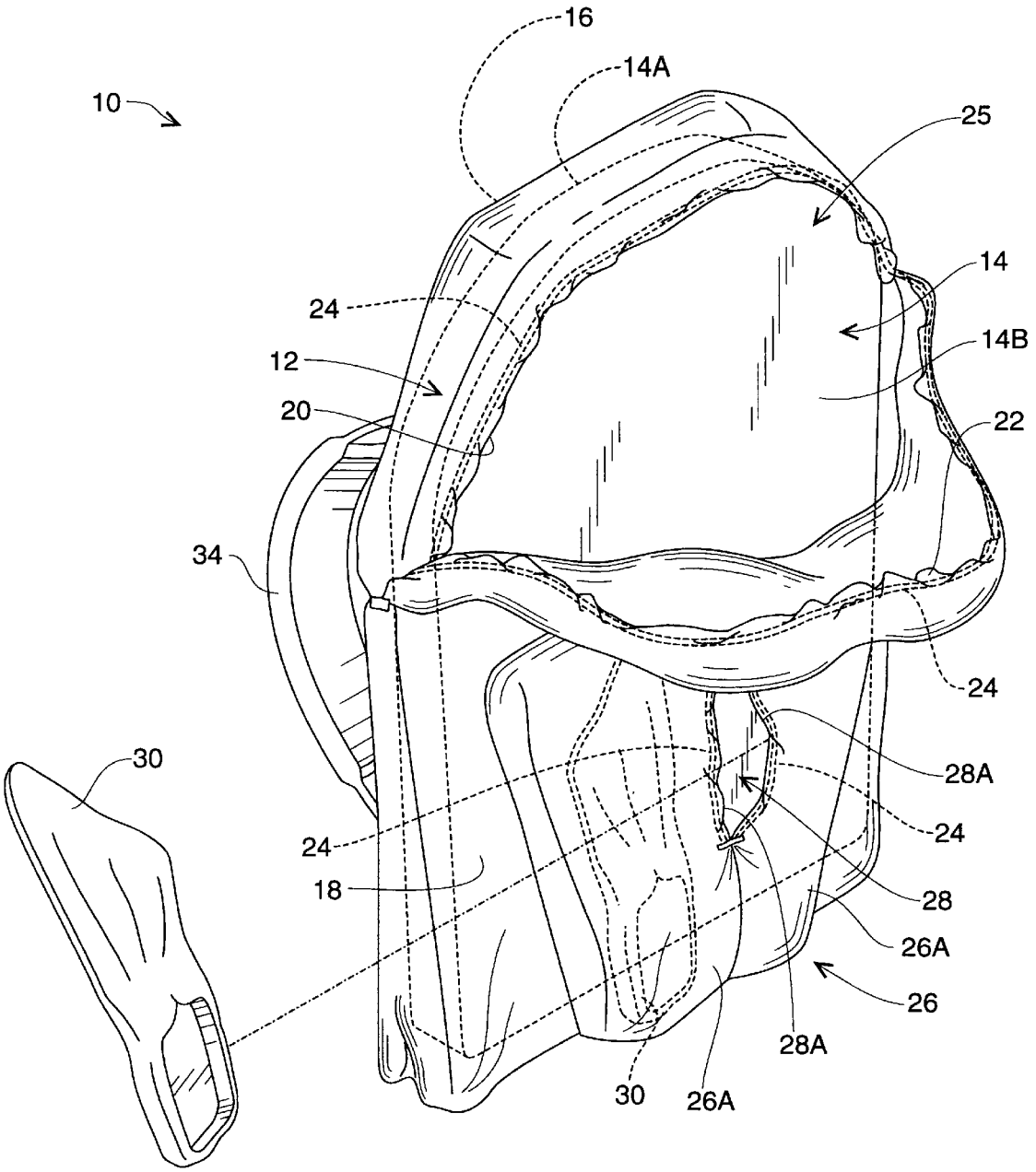
FIG. 1 is a perspective view of a body board bag of the present invention, shown in a generally open condition.
Figure 2:
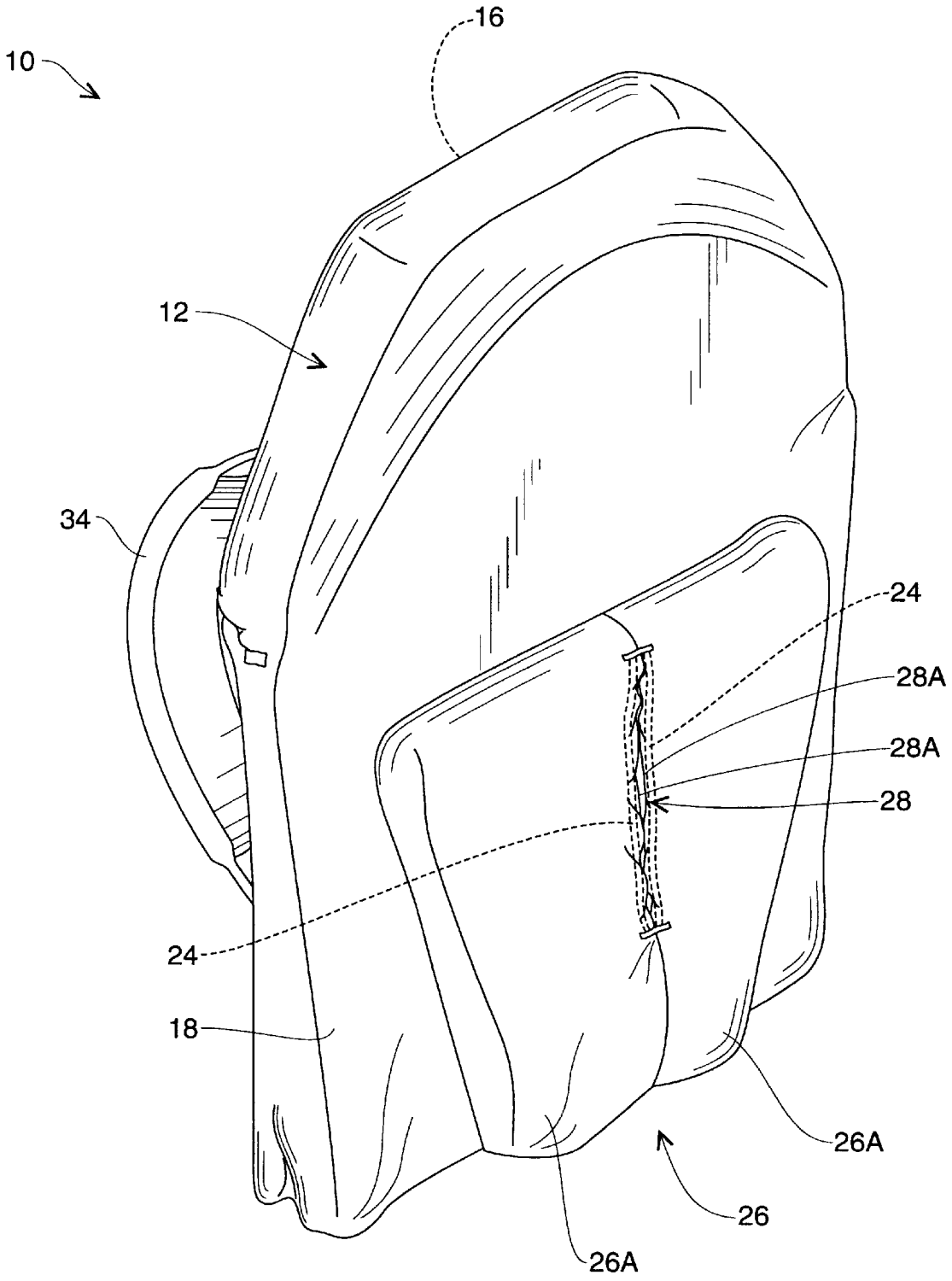
FIG. 2 is a perspective view of the body board bag in a closed condition.
Figure 3:
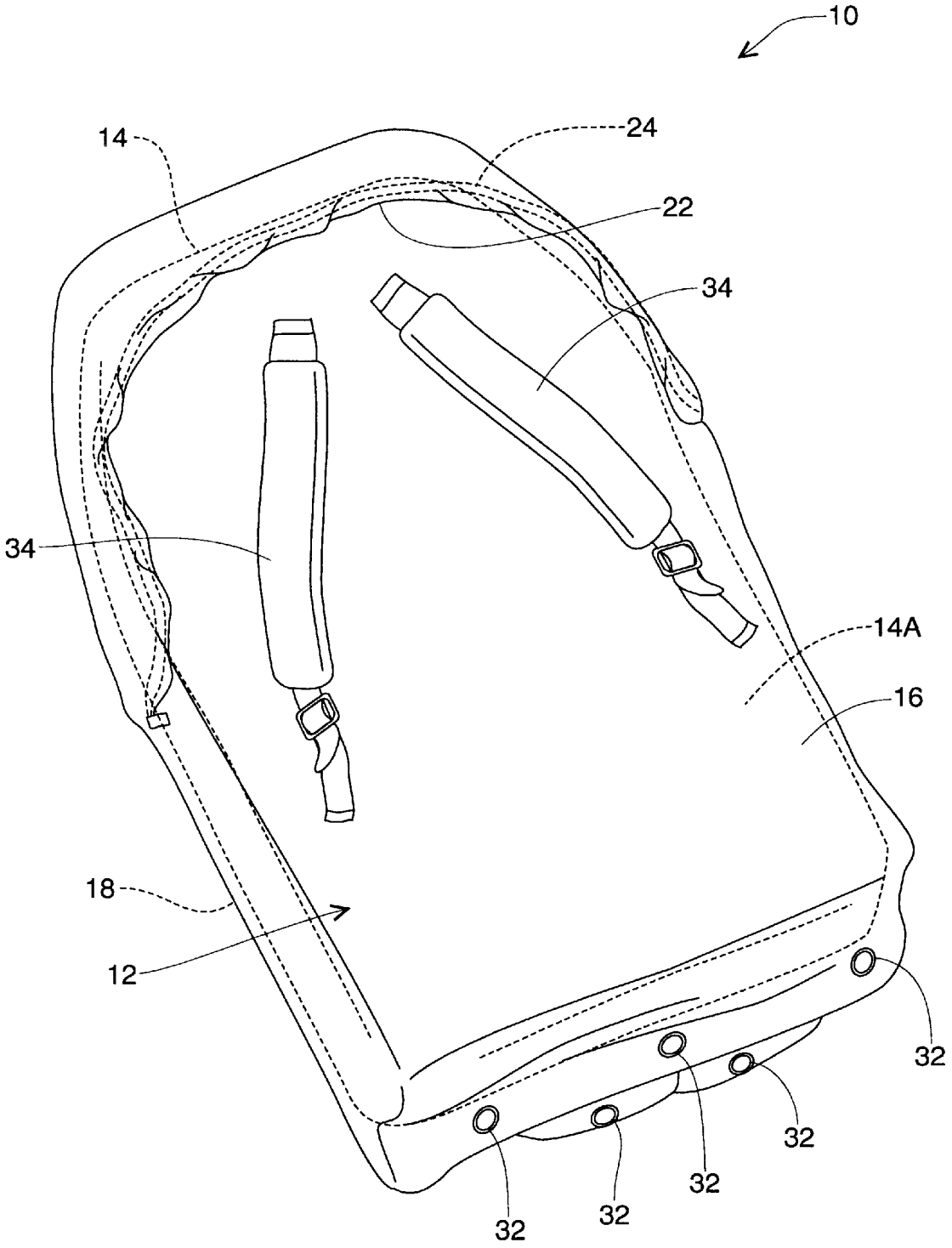
FIG. 3 is a rear perspective view of the body board bag in the closed condition.

FIG. 1 is a perspective view of a body board bag 10 of the present invention, shown in a generally open condition. FIG. 2 is a perspective view of the bag 10 in a closed condition. FIG. 3 is a rear perspective view of the bag 10 in the closed condition. Referring to FIGS. 1–3, the bag 10 includes a compartment 12 adapted to enclose a body board 14 therein.

The compartment 12 includes a first broad panel 16 adapted to cover a first side 14A of the body board 14, and a second broad panel 18 adapted to cover a second side 14B of the body board 14. The first broad panel 16 includes a first lip 20 at a distal end of the first broad panel 16, and the second broad panel 18 includes a second lip 22 at a distal end of the second broad panel 18. The lips 20, 22 are each lined with elastic 24. The lips 20, 22 form a boundary of an opening 25 adapted for the body board 14 to be inserted there-through and into the compartment 12.

The first broad panel 16 is adapted to extend over a distal end of the body board 14 so that the first lip 20 is positioned on the second side 14B of the body board 14. The second broad panel 18 is adapted to extend over the distal end of the body board 14 so that the second lip 22 is positioned on the first side 14A of the body board 14.

An accessory compartment 26 is attached to the second broad panel 18. The accessory compartment 26 includes structure forming an elongated accessory compartment opening 28. The accessory compartment opening 28 is positioned generally in a center of the accessory compartment 26, and divides the accessory compartment 26 into two sections 26A. The accessory compartment 26 is adapted to retain at least two swim fins 30 therein, at least one of the swim fins 30 in each of the sections 26A.

The accessory compartment opening 28 is bounded by elongated edges 28A. Each of the edges 28A is lined with elastic 24, similarly to the lips 20, 22.

Referring particularly to FIG. 3, eyelets 32 in the bottom of the compartment 12 and the accessory compartment 26 permit sand, water and debris (not shown) to fall there-through when the bag 10 is in an upright position. This upright position is shown in FIGS. 1 and 2. As shown in FIG. 3, the eyelets 32 are preferably reinforced by grommets.

Shoulder straps 34 attached to the first broad panel 16 permit the bag 10 to be carried on a person's back (not shown) in a conventional manner.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A bag for carrying a body board, the bag comprising:

a. a compartment adapted to enclose the body board therein;

b. the compartment comprising at least one aperture therein, the aperture positioned generally at a bottom of the compartment when the bag is positioned in an upright manner, the aperture adapted for sand to exit the compartment there-through;

c. the compartment comprising a first broad panel adapted to cover a first side of the body board, and a second broad panel adapted to cover a second side of the body board;

d. the first broad panel comprising an elastic lined first lip at a distal end of the first broad panel, and the second broad panel comprising an elastic lined second lip at a distal end of the second broad panel;

e. the lips forming a boundary of an opening adapted for the body board to be inserted there-through and into the compartment; and f. the first broad panel adapted to extend over a distal end of the body board so that the first lip is positioned on the second side of the body board, and the second broad panel adapted to extend over the distal end of the body board so that the second lip is positioned on the first side of the body board, whereby the compartment is closed about the distal end of the body board and the body board is retained within the compartment.

2. The bag of claim 1, further comprising an accessory compartment attached to the second broad panel, the accessory compartment comprising:

a. structure forming an elongated accessory compartment opening;

b. the accessory compartment opening being positioned generally in a center of the accessory compartment, and dividing the accessory compartment into two sections, the accessory compartment adapted to retain at least two swim fins therein, at least one of the swim fins in each of the sections; and c . the accessory compartment opening being bounded by two elastic lined elongated edges, whereby the swim fins are insertable through the accessory compartment opening into the sections, and the swim fins are securely retainable within the sections.

3. The bag of claim 2, wherein each of the sections comprises at least one section aperture therein, the section aperture positioned generally at a bottom of the section when the bag is positioned in an upright manner, the section aperture adapted for sand to exit the section there-through.

* * * * *